US005561583A

United States Patent [19]

Shideler

[11] Patent Number: 5,561,583

[45] Date of Patent: Oct. 1, 1996

[54] PARTICULATE-REMOVAL RAPPER-CONTROLLER

[76] Inventor: Thomas J. Shideler, 3214 Toulouse Cir., Thousand Oaks, Calif. 91362

[21] Appl. No.: 326,384

[22] Filed: Oct. 20, 1994

[51] Int. Cl.[6] ..... B03C 3/76

[52] U.S. Cl. ..... 361/160; 361/154; 361/195; 361/206

[58] Field of Search ..... 96/32, 36, 37, 96/38; 361/154, 142, 195, 160, 206, 819

[56] References Cited

U.S. PATENT DOCUMENTS

| | | | |
|---|---|---|---|
| 3,477,124 | 11/1969 | Archer et al. | 96/36 X |
| 4,086,646 | 4/1978 | Lanese | 361/166 |
| 4,111,669 | 9/1978 | League, IV | 363/128 X |
| 4,624,685 | 11/1986 | Lueckenotte et al. | 364/483 |
| 5,079,459 | 1/1992 | Huston et al. | 361/166 X |
| 5,114,442 | 5/1992 | Artz | 361/161 X |
| 5,173,867 | 12/1992 | Johnston et al. | 364/550 |

*Primary Examiner*—Fritz M. Fleming
*Attorney, Agent, or Firm*—J. E. McTaggart

[57] ABSTRACT

For dislodging of particulate material from precipitator plates, high voltage electrodes, hoppers, conveyance ductwork, etc., an electro-mechanical rapper module is removably combined with an electronic controller module in a single cylindrical unit that can be controlled and operated independently of any central controller. The rapper is preferably of the type that utilizes a spring-loaded hammer upstroke: being largely independent of gravity it can operate in any orientation. The controller drives the rapper in repetitive bursts at a rate of about 3 impacts per second, and provides selection of impact amplitude, on time and on delay. The unit can be controlled from a remote switch closure, and can be actuated manually by a pushbutton test switch on a control panel inside a top cover. The controller and rapper can be readily separated by removing a clamp, and can be operated as separate electrically-connected units.

20 Claims, 3 Drawing Sheets

PARTICULATE-REMOVAL RAPPER-CONTROLLER

FIELD OF THE INVENTION

The present invention relates to the field of electromechanical impact rappers for dislodging unwanted accumulations in industrial flow processes for particulate materials by repeatedly impacting the outside of a structure handling such material, e.g. a hopper, inclined conduit, smokestack precipitator or the like. More particularly the invention relates to a controller module that is removably combined with a single rapper module.

BACKGROUND OF THE INVENTION

As an example of an industrial process that utilizes rappers, the exhaust of smokestack type plants, such as coal-fired power plants, cement kilns and pulp mills, is cleaned by electrostatic precipitators with vertical plates to remove particulate matter and to thus mitigate air pollution. In the evacuation of the ash residue it is common practice to prevent adhesion, congestion, buildup and flow stoppage by rapping such elements as precipitator plates, high voltage wires and electrodes, and other material-handling structure in a manner to shake the unwanted particles loose.

DISCUSSION OF RELATED KNOWN ART

A commonly known and used type of rapper operates on the principle of magnetic impulse gravity impact (MIGI): a slug that normally rests on a surface, e.g. upper edge of precipitator plate, is picked up an electro-magnetic pulse and then released to drop on the surface. Rappers such as the MIGI rapper that depend on gravity have the disadvantage that the direction of the impulse is limited to a vertical downward direction whereas there are often facilities such as ash hoppers and inclined conduits where it would be desirable to apply rapping in a horizontal, oblique or upward direction, but since the gravity rapper cannot function in those directions, current methods often include such expedients as manual beating on hoppers, e.g. with a sledge hammer, as well as the use of electric or pneumatic vibrators, which due to their repetition rate of impacts often tend to either pack or classify the collected material rather than effectively dislodging it.

Pneumatic rapper designs tend to require considerable maintenance with their need for dryers, lubricators, valves, regulators and air lines.

A precipitator rapper that is suited to the requirements addressed by the present invention utilizes a helical spring rather than gravity to drive the hammer, thus it can be operated in any orientation. Examples of this pulsed DC spring-assisted type of rapper are sold under A.V.C. SR-A1 and Joy/Western ER860. Traditionally rappers of this spring-driven type are controlled in groups from a central control system designed to drive a number of rappers ranging from a few to several hundred typically on a continuous basis. While that type of control scheme is definitely preferred for large precipitators over individual, independent rapper controls, there are some disadvantages including difficulty of testing and adjusting individual rappers. Apart from large precipitators there are many other applications requiring rapping where it is preferable for each rapper to operate independently with its own self-contained controller so that its settings can be customized to the particular application.

OBJECTS OF THE INVENTION

It is a primary object to provide a rapper-controller combination in a single unit that operates independent of any central control system.

It is a further object of the present invention to utilize a type of rapper mechanism that does not rely on gravity and that can be operated in any orientation.

It is a further object to configure a controller module that can connect electrically and mate mechanically with a suitable rapper module to operate as a combined independent rapper-controller unit, the two modules being readily detachable and separately operable via electrical interconnection for service, maintenance and specialized applications.

It is a further object to enable the rapper-controller capability to rap in repetitive bursts of predetermined repetition rate and to provide user adjustment of off time duration, on time duration and impact strength.

It is a further object to provide manual capability of starting and stopping the rapper from a remote location.

It is a still further object to provide local capability of starting and stopping the rapper manually for test purposes.

SUMMARY OF THE INVENTION

The abovementioned objects have been accomplished in a controller module in a cylindrical housing that can be clamped onto the end of the same-diameter cylindrical housing of a rapper module. Components of the controller module are mounted on a circuit board that is specially shock-mounted in the housing. The rapper module is of the pulsed DC solenoid spring-assisted type that minimizes dependence on gravity so it can be utilized not only in a downward directed orientation for precipitator plates but can operated in any orientation for use with hoppers and other inclined-surface material-handling ductwork. The controller and the rapper are clamped together to operate as a single unit, however they can be operated as two separate units connected together electrically. The controller contains user controls for setting the off time and on time of impact bursts and the strength of the impacts; rapper activity can be started and stopped from a remote switch or a pushbutton in the controller module.

BRIEF DESCRIPTION OF THE DRAWINGS

The above and further objects, features and advantages of the present invention will be more fully understood from the following description taken with the accompanying drawings in which.

DETAILED DESCRIPTION

Figure 1:
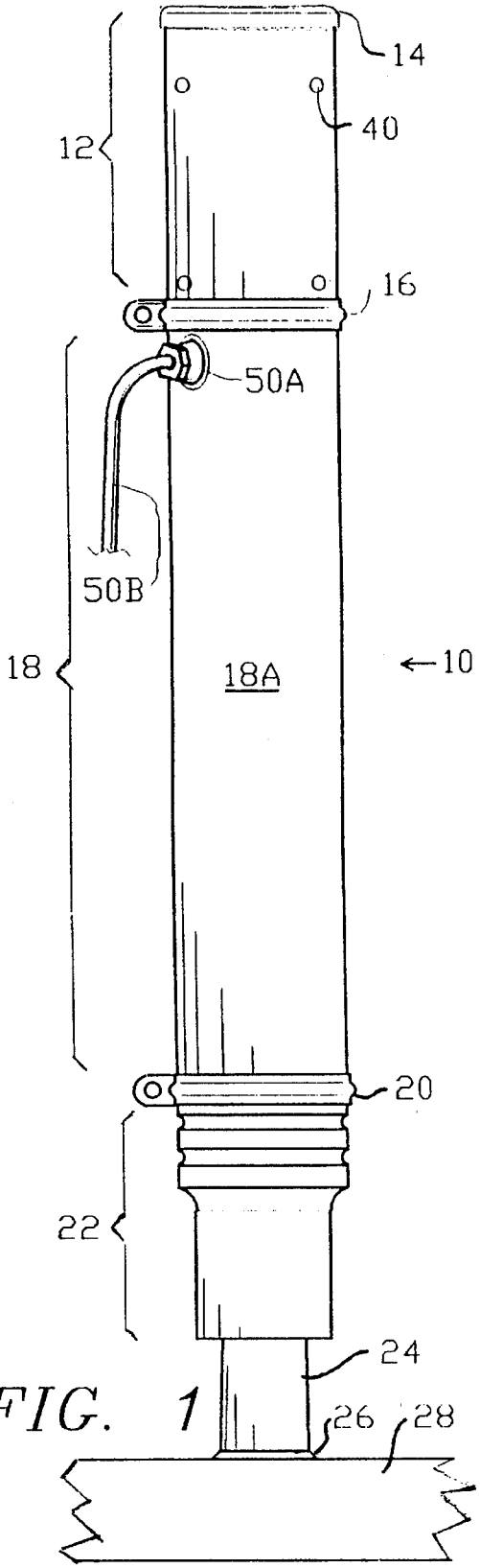
FIG. 1 is an elevational exterior view of a rapper-controller unit of the present invention mounted in place on an object to be rapped.

FIG. 1 is an elevational exterior view of a rapper-controller unit 10 according to the present invention, having a controller portion 12 enclosed at the top by a metal cap 14. The bottom edge of controller 12 is attached by a clamp 16 to the cylindrical rapper housing 18 whose bottom edge is attached by a clamp 20 to a shock-isolating shaft mount assembly 22, fitted onto a tapered stub shaft 24 which is welded at fillet 26 to the metal object 28 which is to be rapped. Typically object 28 is a heavy metal panel of a hopper or other particulate conveyor facility, e.g. a smokestack precipitator. Near the top of rapper housing 18, a cable connector assembly 50A, mounted through a mounting cutout provided in housing 18A, acts as a bushing and strain relief clamp for securing a flexible electrical cable 50A which contains a.c. supply lines and a pair of low voltage lines for controlling unit 10 from an external location.

Figure 2:
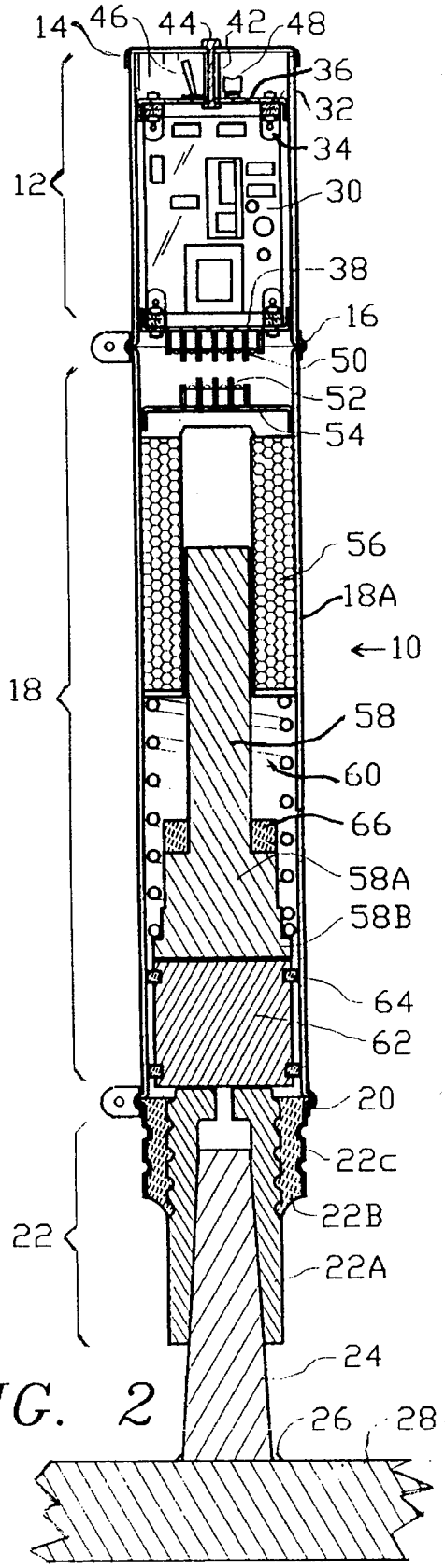
FIG. 2 is a cross-sectional view taken through a central axis of the rapper-controller unit of FIG. 1.

FIG. 2 is a cross-section taken through a central axis of the assembly 10 of FIG. 1, from the same viewpoint. In the controller module 12, a modular controller assembly, consisting of an electronic circuit board 30 and associated components, is shock-mounted via four flexible blocks 32 and angle brackets 34 to two circular flanged panels 36 and 38, one at each end, each shaped to having a peripheral mounting flange by which it is fastened within housing 12, typically by self-tapping screws (40 in FIG. 1). Upper panel 36 is fitted with a threaded bushing 42 engaging a knurled thumb screw 44 which holds cover 14 in place.

Panel 36 serves as the main control panel: visible in this view are a toggle switch 46 for main power on/off and a pushbutton switch 48 for actuating the rapper manually.

The rapper 18 is contained in a heavy metal housing 18A. flanged at both ends. Near the upper end, a circular flanged panel 54 is fastened, carrying a terminal block 52. Located immediately beneath panel 54 is a solenoid 56 and associated movable steel core 58 whose lower end is enlarged to form a hammer 58A. The lower portion of hammer 58A is formed to have a flanged portion 58B supporting a steel coil spring 60 whose upper end bears against the bottom of solenoid 56.

Hammer 58A rests on a steel piston block 62 which is spaced from the walls of the cylindrical housing by a pair of resilient rings 64 set in annular grooves machined into block 62.

Shock-isolating shaft mount assembly 22 is made from three parts shaped as shown with annular grooves: shaft mount 22A which is tapered internally to fit onto stub shaft 24, which is typically made to have a 3.5 degree taper, and provides a top striking surface in contact with block 62. Shaft mount 22A is surrounded by a resilient shock sleeve 22B enclosed by a metal sheath 22C having a flange at the top seized by clamp 20 against a similar flange at the bottom of end of the housing 18A of rapper 18. Sleeve 22B is made from a rubber compound and is bonded to metal shaft mount 22A and to metal sheath 22C. Shaft mount 22B is driven onto stub shaft 24 so as to provide a strong frictional attachment which further strengthens during operation of the rapper 18.

In operation, when solenoid 56 is energized, the magnetic field draws core 58 and hammer 58A upwardly, compressing spring 60. Then when solenoid 56 is de-energized by shutting off its electrical current, spring 60 drives hammer 58A onto the top striking surface of shaft mount 22A which transmits the impact via stub shaft 24 onto object 28. The magnitude of the impact is controlled by the pre-stroke upward displacement of hammer 58A and consequent compression of spring 60; this depends on the amplitude and time duration of the current impulse applied to solenoid 56 immediately before each stroke. Typically the duration of the current impulse is an a range from 50 to 200 milliseconds, and spring 60 is made to have spring constant of 49 lbs per inch.

Located on the top side of hammmer 58A is a resilient ring 66 which serves as a bumper to cushion the mechanical shock in the event the current pulse is made strong enough to pull the hammer upwardly to its limit of travel against the lower side of solenoid 56.

Figure 3:
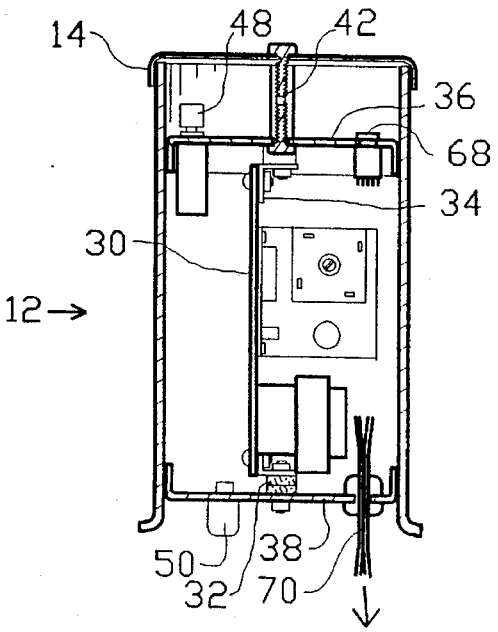
FIG. 3 is an enlarged elevational side view of the controller module shown in FIG. 2, taken perpendicular to the view shown in FIG. 2.

FIG. 3 shows a cross-sectional view of the controller module 12 taken perpendicular to the view shown in FIG. 2, and somewhat enlarged, showing an edge view of the shock-mounted circuit board 30 and associated components. This view also shows a three-section thumbwheel selector switch 68 mounted on control panel 36, and electrical wiring 70, which connects to the rapper, fastened with a strain relief bushing in the lower panel 38.

Figure 4:
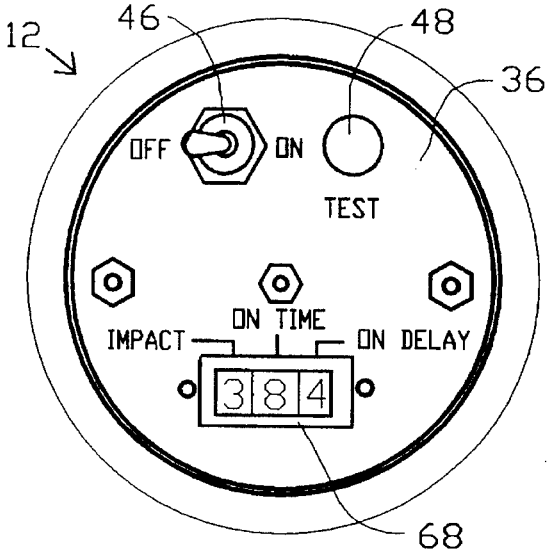
FIG. 4 is an enlarged top view of the controller module of FIGS. 2 with the cap removed to show the control panel and controls.

FIG. 4 is a further enlarged view of the control panel 36, as seen from the top of the controller 10 (FIGS. 1, 2 and 3) with the cap 14 removed, showing power OFF/ON toggle switch 46, test pushbutton 48, and a three-section thumbwheel selector switch 68 displaying a digital setting, an a 1–9 range, in each section.

Figure 5:
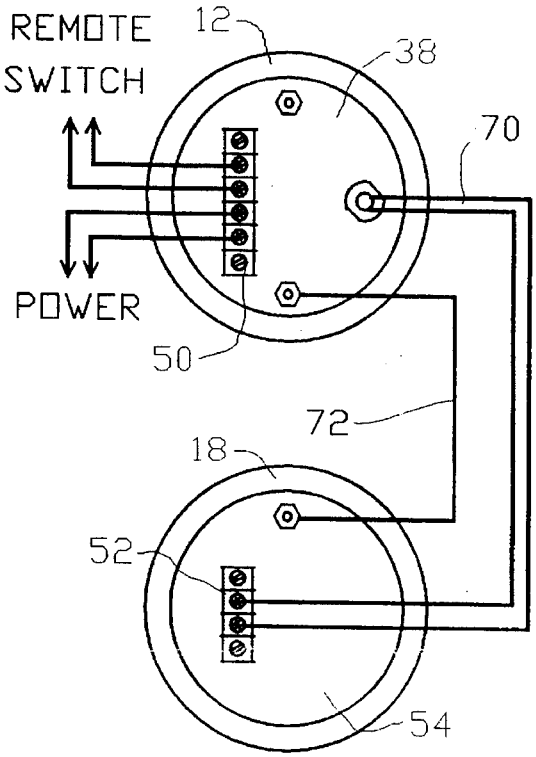
FIG. 5 is a bottom view of the controller module of FIG. 3 and a top view of a rapper module, showing the terminal panels and the electrical interconnections.

FIG. 5 is a bottom view of the controller module 12 from FIG. 3 and a top view of a rapper module 18, and shows the rapper drive wiring 70 and grounding line 72 attached to terminal block 52 of the rapper 18 and also shows the remote switch wires and input power line connected to terminal block 50 of controller module 12.

Figure 6:
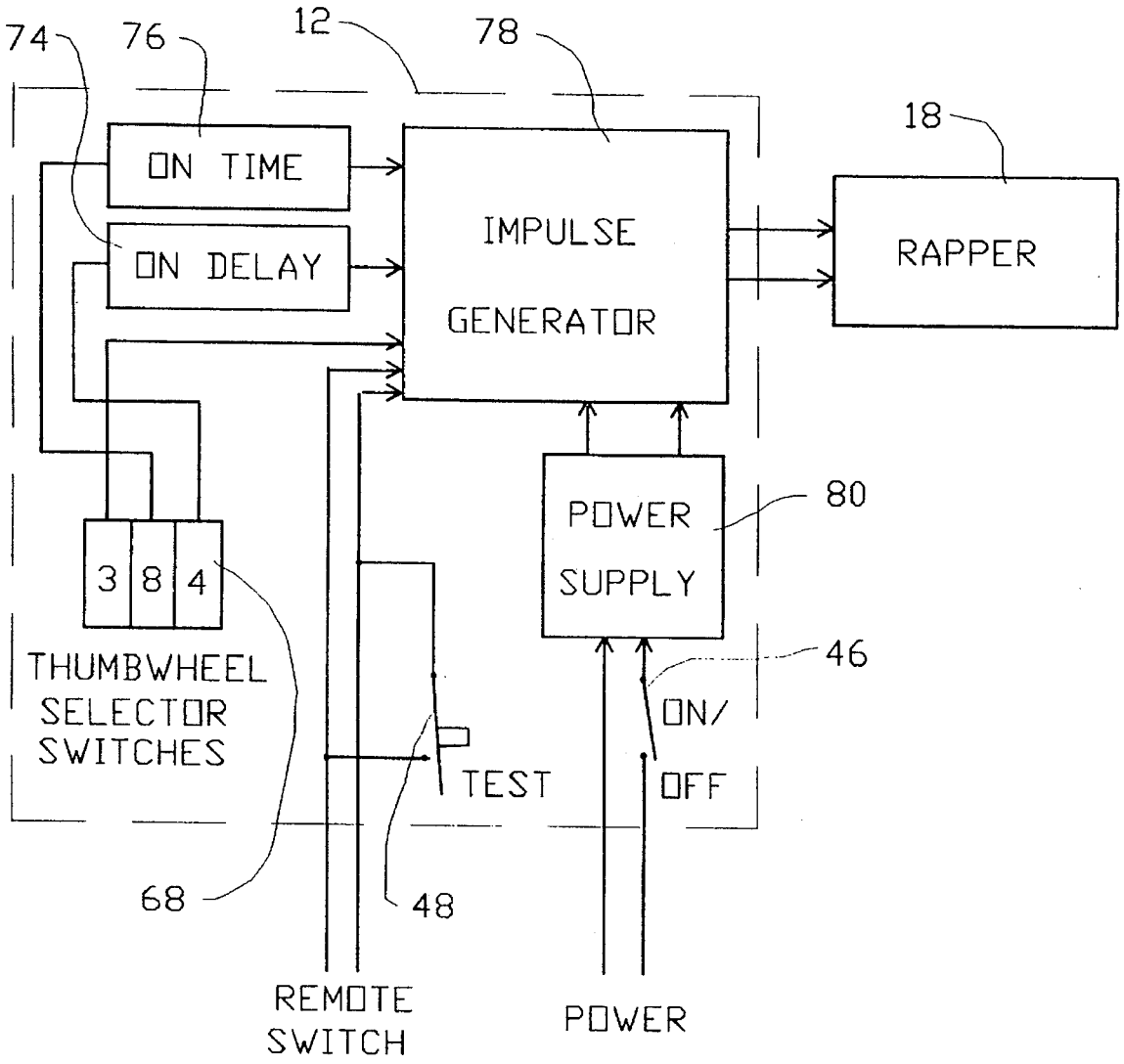
FIG. 6 is functional block diagram of the controller/rapper system showing the interconnection of functional blocks in the controller module.

When controller module 12 and rapper module 18 are assembled together as shown in FIG. 2, panels 38 and 54 and an upper portion of rapper housing 18A form a cylindrical electrical wiring enclosure containing terminal blocks 50 and 52 along with wire leads 70 and 72 (FIG. 5); the wire leads from block 50 (remote switch and power) are implemented as a cable (50B, FIG. 1) passing through housing 18A via cable connector assembly 50A and leading to an external remote switch and a.c. power source as indicated in FIGS. 5 and 6.

FIG. 6 is a functional block diagram of the rapper-controller unit 10 showing components of the controller module 12 that drives rapper 18. A pair of timing circuits 74 and 76, set from corresponding sections of thumbwheel selector switch 68, provide timing control inputs to impulse generator 78 to control the generator's ON DELAY and ON TIME respectively. Generator 78, operating from AC-to-DC power supply 80, drives the solenoid 56 in rapper 18 (FIG. 2) with suitable voltage pulses to achieve the desired rapper action, i.e. repetitive bursts of raps at a predetermined repetition rate, typically up to five per second, with controllable on and off time durations, typically 1–9 seconds. DC power to the solenoid may be controlled by an SCR (silicon controlled rectifier) of known technology, for example GE type SC260D2. The timing circuits can be designed conventionally from commercially available integrated circuits.

Thumbwheel switch unit 68 displays three numbers corresponding to the respective switch settings, 1–9, of the three switch sections:

the IMPACT section, shown as displaying digit "3" controls how hard the rapper hits: this is a function of the solenoid drive pulsewidth, i.e. the time duration of the voltage pulse applied, which in turn determines the upward displacement of the hammer (and the compressive force in the spring) immediately prior to the impact stroke, thus determining the impact force of the rap. Typically the IMPACT control is made to provide a range from 50 milliseconds to 200 milliseconds corresponding to minimum and maximum impact force;

the ON TIME section, shown as displaying digit "8" sets timer 76 to operate the rapper for set time period, following a set delay after a closure of the remote switch or the test pushbutton switch 48, providing a rapping burst in a range of 1–9 seconds duration as indicated on the thumbwheel; and the ON DELAY section, shown displaying digit "4", sets timer 74 to delay the start of the rapper after a switch closure in a range of 1–9 seconds as indicated on the thumbwheel 68.

As long as the test or remote switch remains closed, the off/on cycle repeats, with off time duration as set by the ON DELAY thumbwheel switch and on time duration as set by the ON TIME thumbwheel switch.

Generator 78 can be preset to operate at a repetition rate as high as five raps per second; typically it is preset to operate at three raps per second.

As an example of a typical operating condition: with the ON TIME and ON DELAY both set to 5 seconds, rapping will start 5 seconds after switch closure and continue for 5 seconds, then as long as the switch remains closed this cycle will be repeated with 5 seconds "off" and 5 seconds "on" with 15 raps (5×3) being delivered during the "on" time.

The timing and impact ranges indicated can be readily modified as a matter of design choice.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A rapper-controller for mechanically impacting a material-handling object in order to prevent particulate accumulation, comprising in combination:

an electro-mechanical rapper module, contained in a cylindrical housing, having a movable hammer part that delivers repetitive impact having a predetermined force in response to electrical impulses applied to said rapper module;

means for attaching said rapper module onto the material-handling object in a selected region thereof and for transmitting the impact from the hammer part to the object; and a controller module, supplying the electrical impulses driving said rapper module, contained in a cylindrical controller housing that is removably attached to the housing of the rapper unit in coaxial relationship thereto.

2. The rapper-controller as defined in claim 1 wherein said rapper module comprises:

a spring urging said hammer part toward said object, a solenoid receiving the electrical impulses and thusly, on each impulse, cocking the hammer and loading the spring with a stress force so that, upon de-energizing said solenoid, the stress force from the spring is caused to act on said hammer means to deliver an impact onto the object.

3. The rapper-controller as defined in claim 1 wherein said controller module further comprises electronic repetition rate timing means for making the electrical impulses repetitive and for timing the electrical impulses to have a predetermined repetition rate.

4. The rapper-controller as defined in claim 3 wherein the predetermined repetition rate is preset to be nominally three impulses per second.

5. The rapper-controller as defined in claim 3 wherein said controller module further comprises electronic off/on timing means for operating said rapper module in a repetitive off/on sequence with a designated off time duration and a designated on time duration.

6. The rapper-controller as defined in claim 5 wherein said off/on timing means further comprises:

circuit means, for varying the off time duration, including associated user off time adjustment means; and circuit means, for varying the on time duration, including associated user on time adjustment means.

7. The rapper-controller as defined in claim 6 wherein said circuit means for varying the off time duration and said circuit means for varying the on time duration are each made to have a nominal range from 1 second to 9 seconds.

8. The rapper-controller as defined in claim 6 wherein: the user off time adjustment means comprises a first thumbwheel-type selector switch connected to said circuit means for varying the off time duration, and the user on time adjustment means comprises a second thumbwheel-type selector switch connected to said circuit means for varying the on time duration.

9. The rapper-controller as defined in claim 5 wherein said controller module further comprises remote-switch-control circuit means, associated with said electronic off/on timing means for enabling closure of a remote switch to initiate the repetitive off/on sequence and to continue the sequence as long as the remote switch remains closed, said remote-switch-control circuit means including a pair of terminals for connecting the remote switch.

10. The rapper-controller as defined in claim 9 wherein said controller module further comprises a pushbutton switch connected across the pair of terminals, thus enabling a user to operate said controller module locally in a test mode.

11. The rapper-controller as defined in claim 9 further comprising means for attaching said rapper module to said controller module comprising:

a circular flange extending outwardly from an end of the housing of said rapper module;

a like circular flange extending outwardly from an end of the housing of said controller module; and a clamp engaging said flanges and tightened to hold them together securely in mutually adjacent disposition.

12. The rapper-controller as defined in claim 11 wherein said controller module further comprises a cover cap enclosing an end of the housing of said controller module opposite the end having said flange extending therefrom.

13. The rapper-controller as defined in claim 12 wherein said controller module further comprises:

a rectangular circuit board, carrying electronic circuitry of said controller module; and shock mounting means holding said circuit board in place within the controller housing.

14. The rapper-controller as defined in claim 13 wherein said shock mounting means comprises:

a pair of flanged circular metal end plates disposed coaxially within the housing, and fastened thereto, near respective opposite ends thereof, said circuit board extending between said end plates; and a plurality of resilient shock-mount members each attached to a corresponding end of said circuit board via a corresponding angle bracket and each attached to a corresponding end plate.

15. The rapper-controller as defined in claim 3 wherein said controller module further comprises electronic pulse width control means for varying the electrical impulses with regard to time duration, so as to accordingly vary the force of impact delivered from the hammer part.

16. The rapper-controller as defined in claim 15 wherein said controller module further comprises user impact adjustment means operationally connected to said electronic pulse width control means, enabling the user to vary the force of impact delivered from the hammer part.

17. The rapper-controller as defined in claim 16 wherein said electronic pulse width control means and said user impact adjustment means enable the user to vary the duration of the electrical impulse over a nominal range of 50 milliseconds to 200 milliseconds.

18. The rapper-controller as defined in claim 16 wherein said user impact adjustment means comprises a thumbwheel switch selector.

19. A controller module in for supplying electrical impulses to a solenoid in an electro-mechanical rapper module that includes a solenoid-cocked, spring-driven hammer part that is adapted to deliver repetitive impacts having a predetermined force onto material-handling objects so as to prevent particulate accumulation therein; said controller module comprising:

a cylindrical housing, containing said controller module, that is removably attached to the rapper module in coaxial relationship thereto by means of a clamp that engages a flange on an end of the rapper module and a like flange on an end of said controller module, so as to form a rapper-controller unit;

electronic driving means for generating the electrical impulses;

repetition rate timing means, associated with said electronic driving means, for making the electrical impulses repetitive and for timing the electrical impulses to have a predetermined repetition rate in the order of several impulses per second;

electronic off/on timing means for operating said rapper module in a repetitive off/on sequence with a controllable off time duration and a controllable on time duration;

electronic pulse width control means for varying the electrical impulses with regard to time duration so as to accordingly vary the force of impact delivered from the hammer part;

a circuit board carrying components of said electronic driving means, said circuit board being resiliently shock-mounted within the controller module housing;

an ON DELAY user adjustment control, operationally controlling said off/on timing means, enabling a user to adjust the off time duration;

an ON TIME user adjustment control, operationally controlling said off/on timing means, enabling the user to adjust the on time duration;

an IMPACT user adjustment control, operationally controlling said electronic pulse width control means, enabling the user to vary the force of impact delivered from the hammer part;

remote switch control means, associated with said off/on timing means, for enabling closure of a remote switch to initiate the repetitive off/on sequence and to continue the sequence as long as the remote switch remains closed, said remote-switch-control circuit means including a pair of terminals for connecting the remote switch; and a pushbutton switch, connected across the pair of terminals, enabling the user to operate the rapper-controller unit locally in a test mode.

20. The controller module as defined in claim 19 wherein said electronic off/on timing means and said electronic pulse width control means are configured with component parameters sized such that:

said ON DELAY user adjustment control enables the user to vary the off time duration over a nominal range from 1 to 9 seconds;

said ON TIME user adjustment control enables the user to vary the on time duration over a nominal range from 1 to 9 seconds; and said IMPACT user adjustment control enables the user to vary the duration of the electrical impulse over a nominal range of 50 milliseconds to 200 milliseconds.

* * * * *